United States Patent [19]

Verdier

[11] 4,277,933

[45] Jul. 14, 1981

[54] RIDING SADDLE

[76] Inventor: Henri Verdier, 1 Passage Traynes, 65000 Tarbes, France

[21] Appl. No.: 77,062

[22] Filed: Sep. 19, 1979

Related U.S. Application Data

[63] Continuation of Ser. No. 829,042, Aug. 30, 1977, abandoned.

[30] Foreign Application Priority Data

Aug. 25, 1976 [FR] France ..... 76 2186

[51] Int. Cl.[3] ..... B68C 1/02

[52] U.S. Cl. ..... 54/44

[58] Field of Search ..... 54/37, 38, 40, 42, 44, 54/45

[56] References Cited

U.S. PATENT DOCUMENTS

| | | | |
|---|---|---|---|
| 914,546 | 3/1909 | Amos | 54/44 |
| 2,315,487 | 4/1943 | Steele | 54/44 |
| 3,780,494 | 12/1973 | Nankivell, Jr. | 54/44 |

FOREIGN PATENT DOCUMENTS

| | | | |
|---|---|---|---|
| 27255 | 1/1907 | Austria | 54/44 |

*Primary Examiner*—Gene Mancene
*Assistant Examiner*—Robert P. Swiatek
*Attorney, Agent, or Firm*—James C. Wray

[57] ABSTRACT

A saddle-bow made integrally with a substantially oval cambered part, forming a seat, extended by two elongated portions which are orientated in the same direction and which are separated one from the other by a hollowed-out region to form a gap into which the withers of the horse may fit.

7 Claims, 9 Drawing Figures

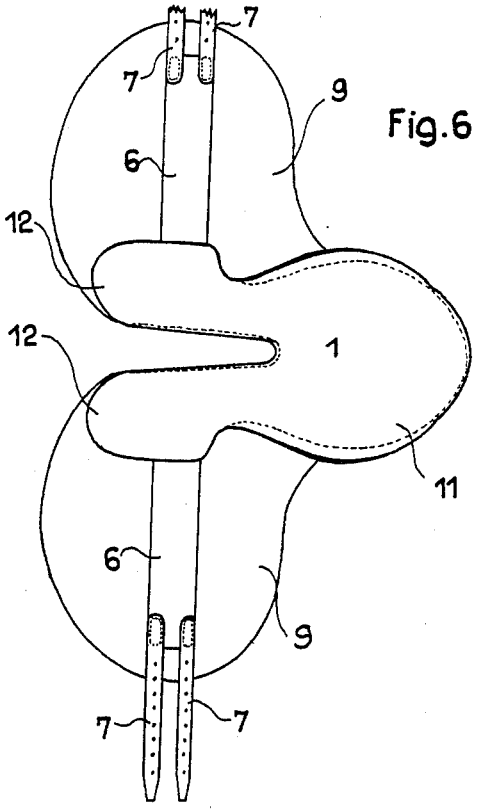
Fig.6
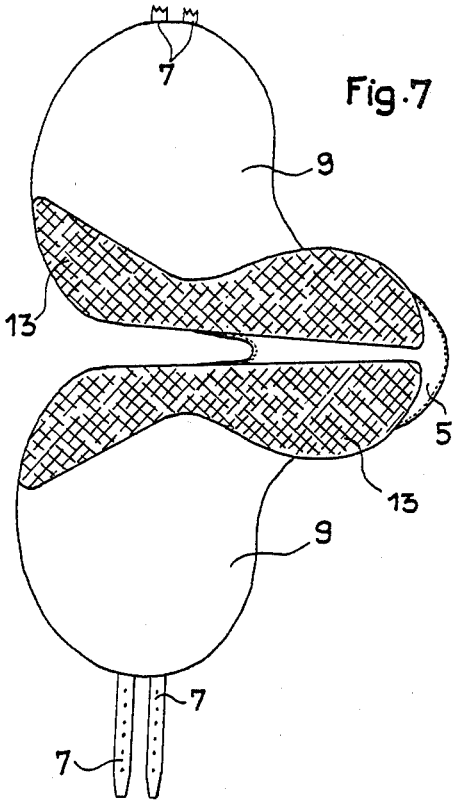
Fig.7
Fig.8
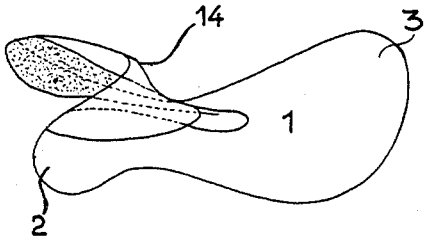
Fig.9
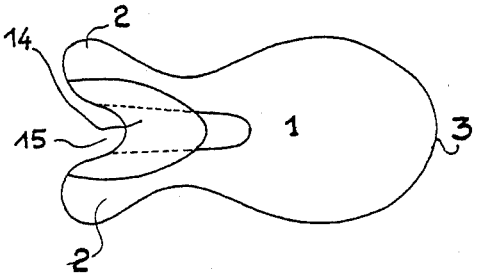

RIDING SADDLE

This is a continuation of application Ser. No. 829,042, filed 8-30-77, and now abandoned.

BACKGROUND TO THE INVENTION

This invention relates to saddle-bows for horse rising saddles.

The invention makes it possible to produce saddles without any risk of injuring horses whose withers are very prominent.

Known conventional saddles of this kind are mounted on saddle-bows made of two curved blades of wood, joined at the ends by two arches, also made of wood, called the cantle and the pommel respectively. This unit is covered with cloth and coated with strong glue. Thin strips of steel are riveted to the unit to reinforce it; the pommel, being the place subjected to the greatest stress, is lined with strips which may be as much as 5 mm thick, the horse's withers, being "wedge-shaped", have a tendency to push this aside and it is not unusual for the saddle-bow to break at this point.

The irons are riveted on the saddle-bow and the girth-straps are nailed on it.

Cloth straps stretched lengthways and widthways provide the slope and the hollow of the seat which is covered with a piece of leather.

For years there have been steel-reinforced glass fiber and resin saddle-bows of conventional type on which the various components of the saddle are nailed, stitched, riveted or screwed, assembly being the same as on wooden saddle-bows.

Known saddles have many drawbacks, notably a very important one which lies in the tricky manufacture of the saddle-bow and the complicated assembly of the saddle.

Another drawback relates to comfort, in fact saddles sold at present have to be "broken in", i.e. the rider has to strain for many hours to form the hollow in the saddle at the required place.

Moreover, this hollow is not final and if the rider who formed it lends his saddle for a while, this hollow may be deformed and displaced.

Some horses are very difficult to saddle without injuring their withers (these being very prominent) since the pommel touches them. To prevent these injuries, one or several thick squares of felt called "pads" are inserted to raise the pommel, but then the saddle is tipped backwards.

The arch of the pommel often breaks under violet stress, if the horse is very tightly girthed or falls on its back.

OBJECTS OF THE INVENTION

The object of the invention are to avoid the above mentioned drawbacks, especially avoiding risk of injury to the horse or damaging the front part of the saddle-bow. Furthermore, due to simplicity of design the saddle-bow can be mass produced.

The slope and hollow of the seat are created during assembly by foam rubber of greater or lesser thickness at the appropriate places and stuck to the steel. They can no longer be deformed since the rubber returns to its identical position.

It is no longer necessary to break-in the saddle.

SUMMARY OF THE INVENTION

According to the invention there is provided a saddle-bow comprising a seat portion of substantially oval shape and curved both along a longitudinal axis and transversely of said axis to fit the horse's back, and two forwardly extending elongated portions formed integrally with said seat portion, said elongated portions being separated by a gap extending along the longitudinal axis and curved to conform substantially to the horse at each side of the region of the withers, slanting in opposite directions to conform to the horse's withers, and elastically deformable whereby said portions are capable of diverging to an extent determined by the amount of pressure between the saddle-bow and horse.

To form the seat, the substantially oval rear part, incurved along the longitudinal median axis of the part forming the saddle-bow, is cambered along the transverse median axis so as to have a central area which is hollow in relation to the cantle and forwardly extending portions.

Other advantages and characteristics of the invention will emerge from a reading of the description given below of a preferred mode of embodiment given as a non-limiting example and illustrated by the attached drawings, in which:

FIGS. 4 to 7 show the different phases of making the saddle on basis of said saddle-bow FIG. 8 and 9 show another mode of embodiment of the saddle-bow with pommel.

DESCRIPTION OF PREFERRED EMBODIMENT

The saddle-bow which is preferably made in one piece, e.g. steel sheet or any other suitable material, comprises a substantially oval seat portion 1 extended by two elongated portions 2 separated from each other by a hollowed-out region 3 forming a gap.

The oval seat portion 1 is incurved, i.e. cambered upwards along its longitudinal median axis to form the cantle 4 and along its transverse median axis, which helps to pre-shape the seat.

The portions 2 are arched so that they diverge from each other to form the hollowed-out region 3 substantially following a direction shaped like a portion of a spiral away from each other, which makes it possible to follow the shape of the sides of the horse's withers, which will fit into the hollowed-out region 3. The portions 2 are elastically deformable so that they can diverge from each other to an extent determined by the amount of pressure of the saddle-bow on the horse.

The saddle-bow according to the invention can be made in one piece which can be cut out and shaped, on a press for example.

Figure 1:
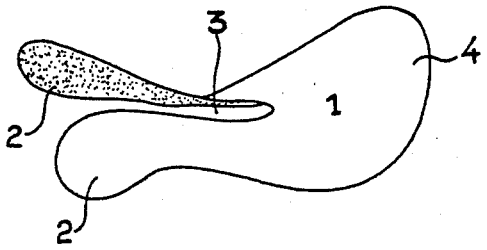
FIGS. 1 to 3 show the saddle-bow
Figure 2:
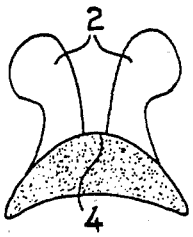
Figure 3:
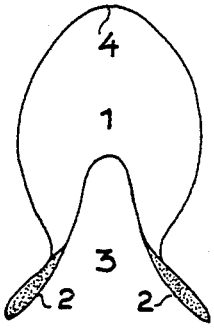
Figure 4:
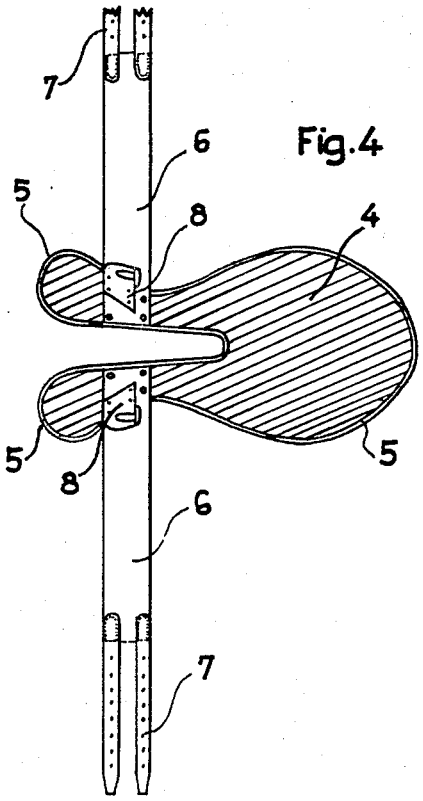
Figure 5:
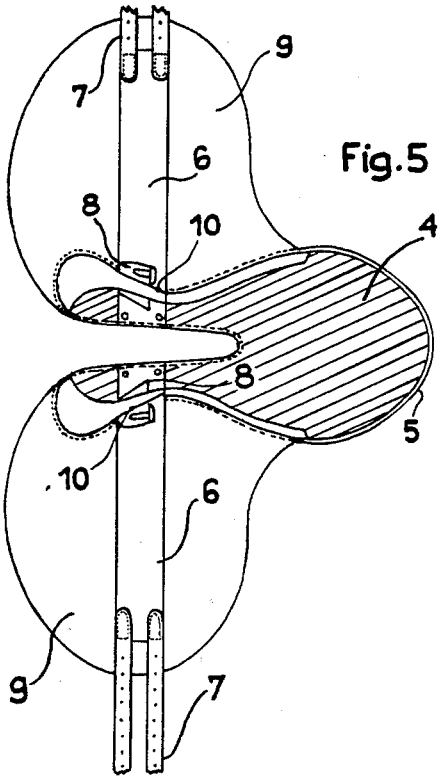

Under this saddle-bow, as shown in FIGS. 4 and 5, a slightly projecting piece of leather 5 is stuck or e.g. fixed by riveting.

On each of the portions 2 a leather strap 6 is fixed, with girth-straps and the irons 8 attached e.g. by riveting.

The sweat flaps 9 fixed to the saddle-bow on a level with the portions 2 and the seat have a slot 10 to allow the passage of the irons and girthholders.

The saddle receives the piece(s) of leather 11 forming the seat and the small sweat flaps 12, and under the saddle-bow (FIG. 7) the padding 13 is arranged and fixed to the leather 5, e.g. by lacing.

According to another arrangement of the invention shown in FIGS. 8 and 9, the saddle-bow made in one piece is fitted at the portions 2 with a pommel 14 which straddles the hollowed-out region 3 and which slants towards the seat.

Said pommel has a frontal hollowed-out part 15 substantially up to its top, which makes it possible to accommodate the horse's withers.

Said pommel can be a piece, e.g. of metal, added to the saddle-bow.

The saddle-bow can be used in a conventional saddle as well as a training or racing saddle, in each case avoiding the aforementioned drawbacks.

The present invention can be subjected to modifications or variants within the limits of the technical equivalents without thereby departing from the scope of this patent.

I claim:

1. A riding saddle comprising a saddle-bow integral with a substantially oval cambered part forming a seat and two forward opening, divergent branches orientated in the same direction and separated from each other by a hollowed-out portion forming a gap into which the horse's withers will fit, said branches being freely and mutually unconnected.

2. A saddle-bow, according to claim 1, wherein the two branches are arched and diverge from each other, and slant in opposite directions to each other along a longitudinal median axis of said saddle-bow.

3. A saddle-bow according to claim 1, wherein the rear part is substantially oval and is incurved along a longitudinal median axis and is cambered along a transversal median axis so as to have a depressed central area.

4. A saddle-bow, according to claim 1, made integrally of metal.

5. A saddle-bow, according to claim 1, made integrally of non-metal.

6. A saddle-bow comprising (a) a seat portion of substantially oval shape and curved both along a longitudinal median axis and transversely of said axis, to fit the horse's back, and (b) two freely and mutually unconnected forwardly extending elongted portions formed integrally with said seat portion, said elongated portions being forward opening, divergent and (i) separated by a gap extending along the longitudnal axis and curved to conform substantially to the horse at each side of the region of the withers, (ii) slanted in opposite directions to conform to the sides of the horse's withers, and (iii) elastically deformable whereby said portions are capable of diverging to an extent determined by the amount of pressure between the saddle-bow and horse.

7. A saddle-bow according to claim 6, made of pressed steel.

* * * * *